US005807219A

United States Patent [19]

Webber et al.

[11] Patent Number: 5,807,219

[45] Date of Patent: Sep. 15, 1998

[54] EXERCISE APPARATUS ADAPTABLE FOR HANDICAPPED AND NON-HANDICAPPED USERS

[76] Inventors: Randall T. Webber, 11162 Morning Creek Dr., San Diego, Calif. 92128; Bruce Hockridge, 4963 Greenbrier Ave., San Diego, Calif. 92120

[21] Appl. No.: 579,795

[22] Filed: Dec. 28, 1995

[51] Int. Cl.[6] ..... A63B 21/00

[52] U.S. Cl. ..... 482/134; 482/100; 482/138; 482/142

[58] Field of Search ..... 482/99, 100, 133, 482/134, 138, 904, 908, 142

[56] References Cited

U.S. PATENT DOCUMENTS

| | | | |
|---|---|---|---|
| 4,153,244 | 5/1979 | Tauber, Jr. | 482/94 |
| 4,369,966 | 1/1983 | Silberman et al. | 482/38 |
| 4,747,595 | 5/1988 | Mabry et al. | 482/99 |
| 4,907,798 | 3/1990 | Burchatz | 482/99 |
| 4,911,435 | 3/1990 | Johns | 482/99 |
| 4,919,419 | 4/1990 | Houston | 482/138 |
| 4,964,632 | 10/1990 | Rockwell . | |
| 5,044,629 | 9/1991 | Ryan et al. | 482/908 |
| 5,069,447 | 12/1991 | Snyderman et al. | 482/142 |
| 5,080,351 | 1/1992 | Rockwell | 482/138 |
| 5,100,128 | 3/1992 | Mabry et al. | 482/134 |
| 5,217,422 | 6/1993 | Domzalski | 482/100 |
| 5,277,685 | 1/1994 | Gonzales | 482/134 |
| 5,362,297 | 11/1994 | Muir | 482/134 |
| 5,370,595 | 12/1994 | Voris et al. | 482/142 |

OTHER PUBLICATIONS

Progym, Flaghouse Rehab, The Catalog for Rehabilitation Professionals, p. 20, 1995.

*Primary Examiner*—Richard J. Apley
*Assistant Examiner*—Victor K. Hwang
*Attorney, Agent, or Firm*—Brown, Martin, Haller & McClain, LLP

[57] ABSTRACT

A weight lifting exercise machine has an adjustable seat supporting arm assembly to permit the machine to be used by handicapped users in a wheelchair as well as non-handicapped users. In a first condition, an extendible support arm is secured in a seat-supporting position projecting forwardly from an upright frame member carrying a back rest so as to support a seat pad in an appropriate position relative to the back rest for use by a seated, non-handicapped user. In a second condition, the seat pad is removed from the arm and the arm is retracted rearwardly to provide a space for positioning a wheelchair adjacent the upright member with a user in an equivalent position to a non-handicapped user for access to the exercise equipment.

12 Claims, 7 Drawing Sheets

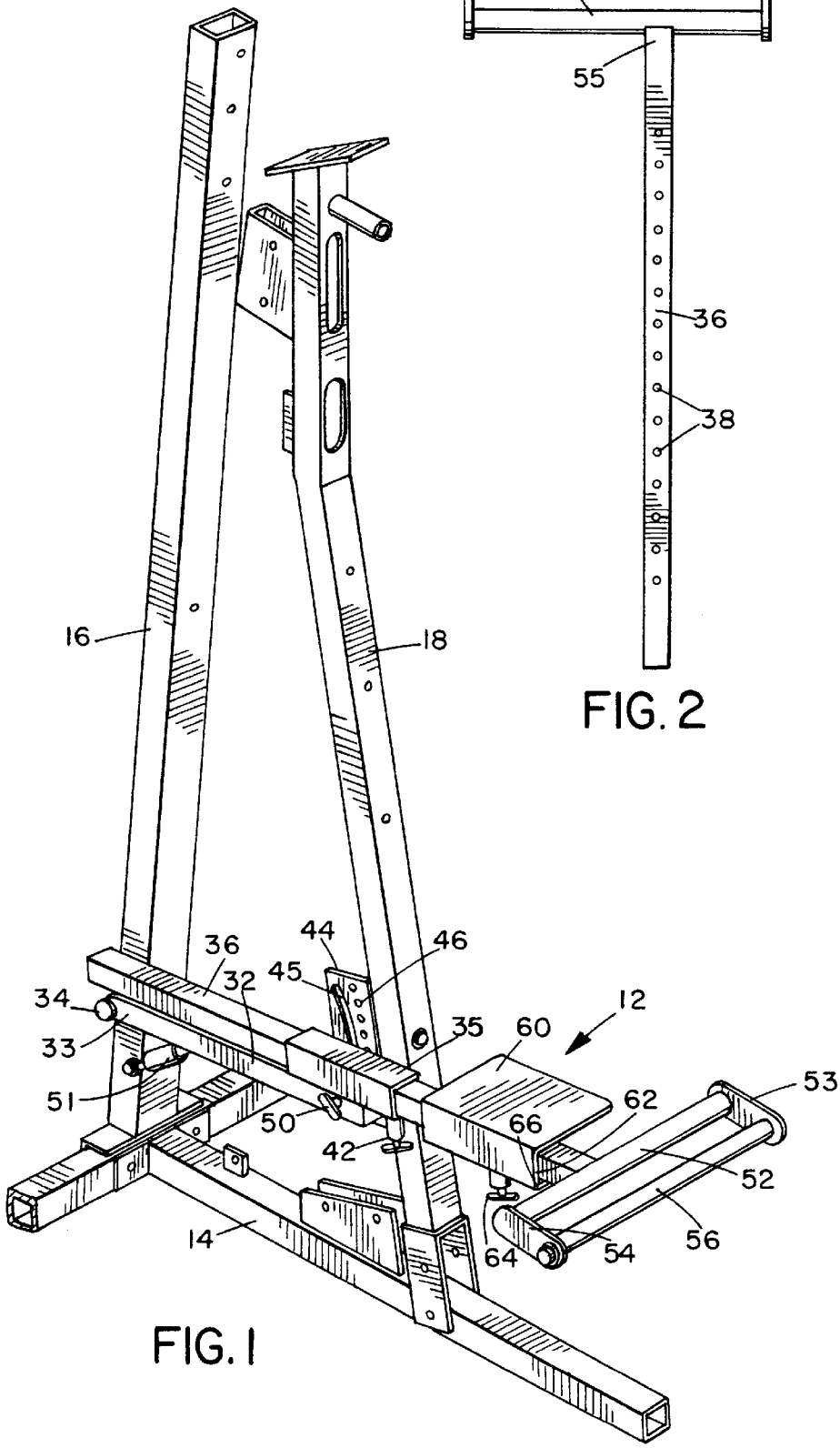
FIG. 1
FIG. 2
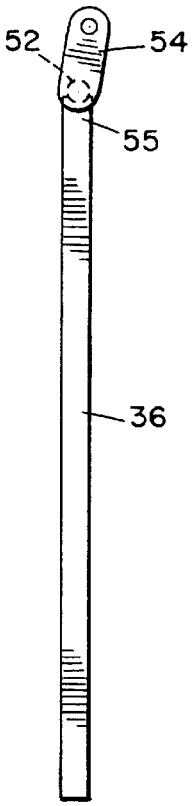
FIG. 3

EXERCISE APPARATUS ADAPTABLE FOR HANDICAPPED AND NON-HANDICAPPED USERS

BACKGROUND OF THE INVENTION

The present invention relates to exercise apparatus of the weight lifting type which includes equipment for exercising various different muscle groups, all linked via a cable and pulley mechanism to a weight stack or other resistance device, in a single machine. It is particularly concerned with a weight-lifting type of exercise machine which is adaptable for handicapped and non-handicapped users.

Weight lifting machines or home gyms are generally designed for use by an individual in a seated position on a seat mounted on a support frame of the machine or in a standing position, depending on the type of exercise. Machines for use by handicapped users in wheelchairs have been designed. However, it would be prohibitively expensive, in most cases, for a single family to purchase both types of machine where both handicapped and non-handicapped users wish to exercise. It is also expensive for health clubs and the like to purchase two of every type of exercise machine, to allow for use by handicapped or non-handicapped individuals.

SUMMARY OF THE INVENTION

It is an object of the present invention to provide a new and improved exercise apparatus of the weight lifting type which is adaptable for use by a handicapped user or a non-handicapped user.

According to the present invention, an exercise apparatus is provided which comprises a support frame having a base and at least one upright member, a resistance device on the frame for providing resistance to exercises performed on the apparatus, a plurality of exercise members for performing different types of exercises, a cable and pulley linkage linking each exercise member to the resistance device, a support member mounted on the frame having an extendible portion movable between an extended position projecting in a first direction from the upright member and a retracted position, and a seat pad releasably mountable on the extendible portion in the extended position for supporting a user to perform exercises in a seated position, whereby space is provided adjacent the upright member for a wheelchair when the extendible portion is in the retracted position.

Preferably, the support member has a first end pivotally mounted on the frame and a securing mechanism for securing the support member at a desired orientation, whereby the height of an opposite, outer end of the extendible portion can be adjusted. A roller is preferably mounted at the outer end of the extendible portion. This acts as a support behind the knee of a seated user when the portion is extended and in use as a seat support. The extendible portion preferably includes an adjustment mechanism for securing the extendible portion at a plurality of different extensions between the fully retracted and fully extended positions, to adjust for different users performing different exercises, and between handicapped users in a wheelchair and non-handicapped users. When the extendible portion is fully retracted, a user can position a wheelchair in the area normally occupied by a seat and perform chest press exercises and the like. A wheelchair user may also position the wheelchair facing the upright member and extend the extendible portion so that the roller rests over their upper legs while they perform other exercises. In this position, the roller will resist the tendency for the user's body to lift out of the seat or wheelchair as exercises are performed.

The exercise apparatus of this invention can be used by either a handicapped user in a wheelchair or a non-handicapped user in a seated or standing position, and avoids the need for specialized exercise equipment to be purchased for handicapped users. This will reduce the expense of such equipment, particularly for handicapped users, and make various types of upper body exercises normally provided on weight machines accessible to an individual confined to a wheelchair.

The support member of this invention may be installed on an existing exercise machine simply by removing the conventional seat support member and mounting the adjustable support member in its place. Thus, existing machines may be retrofitted for access by users in wheelchairs.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which:

FIG. 1 is a partial perspective view of a weight machine incorporating an adjustable support device according to a preferred embodiment of the present invention;

FIG. 2 is a bottom plan view of an extendible arm forming part of the support device;

FIG. 3 is a side elevation view of the arm of FIG. 2;

DESCRIPTION OF THE PREFERRED EMBODIMENT

Figure 4:
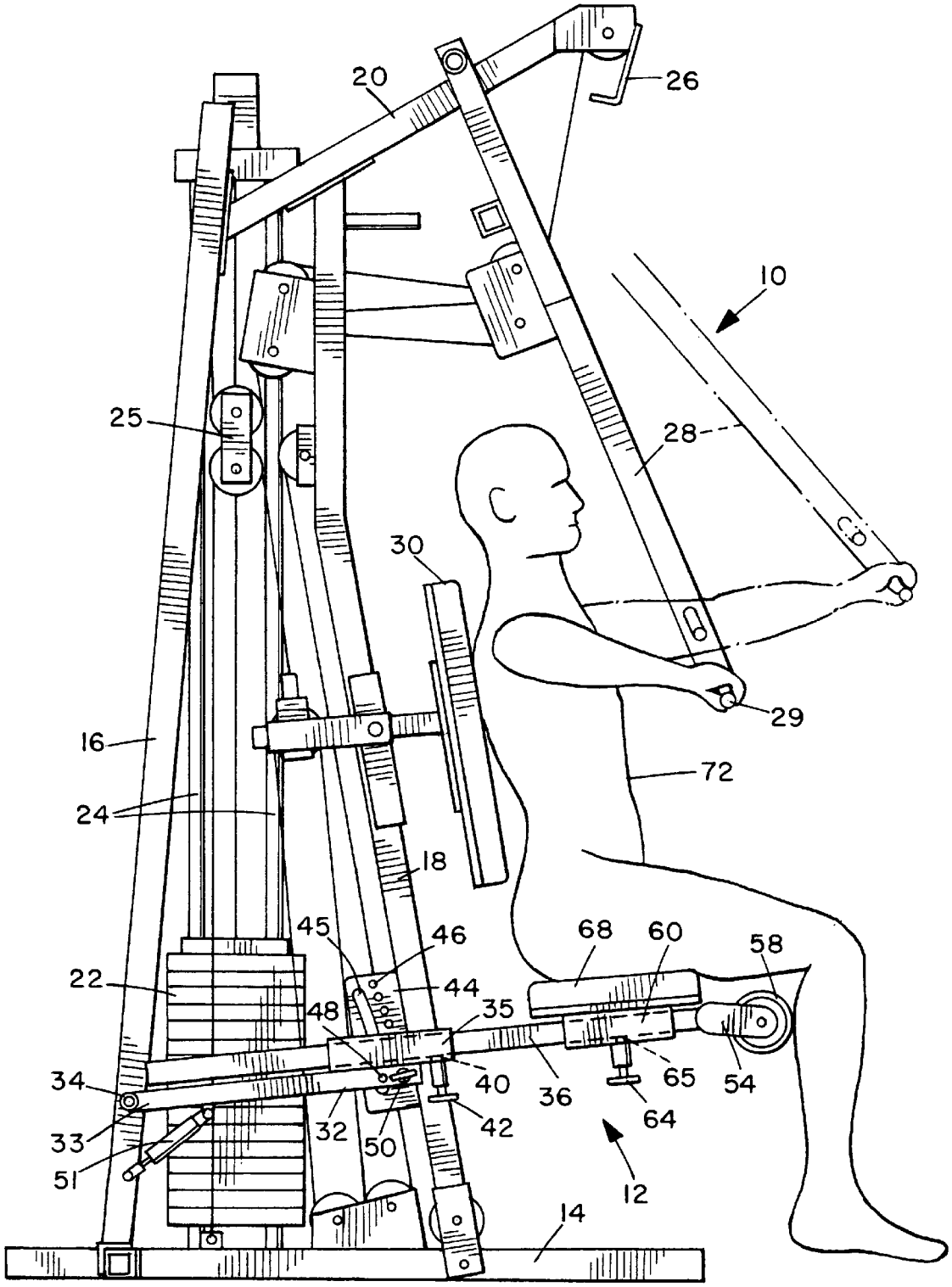
FIG. 4 is a side elevation view of the weight machine with the adjustable support device in a first position for use by a non-handicapped individual.

FIGS. 1 and 4 to 7 illustrate an exercise apparatus or weight machine 10 on which an adjustable support device 12 according to a preferred embodiment of the present invention is installed. The exercise apparatus 10 is otherwise conventional, and comprises a support frame having a base 14, a rear upright member 16, a forward upright member 18, and an upper or top frame member 20 extending from the rear upright and across the upper end of upright 18. The base also includes a standard, transversely extending, rear support member. A weight stack 22 is slidably mounted on guide rods 24, and may be raised and lowered via a cable and pulley mechanism 25 which links the weight stack to various exercise stations. The exercise stations include a pull down bar 26 and a chest press bar or lever arm 28. Lever arm 28 is provided with handles 29 for gripping by a user. A back rest or back pad 30 is adjustably mounted at an appropriate height on the forward upright member 18.

The adjustable support device 12 is illustrated in detail in FIGS. 1 to 3. The support device 12 basically comprises a first arm 32 having a rear end 33 pivotally mounted on the rear upright member 16 via pivot pin 34, and a hollow sleeve 35 secured at the forward end of the first arm, and a second, extendible arm 36 having a rear end extending slidably through the hollow sleeve 35. The arm 36 is illustrated in FIGS. 2 and 3 and has a plurality of spaced openings 38 for selective alignment with an opening 40 in the lower wall of sleeve 35. A spring loaded locking or pull pin 42 is biassed to extend through opening 40 and any aligned opening 38 in arm 36 to lock the arm at a desired extension. Thus, the overall length of the two arms 32 and 36 may be readily adjusted. In an alternative arrangement, the openings may be provided on arm 32 or sleeve 35, and the spring-loaded locking or pop pin 42 may be mounted on arm 36. This allows length of the support device 12 to be readily adjusted between a large range of different lengths.

A range-of-motion or adjustment bracket 44 is secured to the forward upright member 18 so as to extend from a location just below the height of pivot pin 34 to a location spaced above the pivot pin, as illustrated in FIGS. 1 and 4. Bracket 44 has a first, arcuate slot 45 centered on pivot pin 34, and a set of spaced openings 46 extending in an arc from the lower edge to the upper edge of the plate, also centered on pivot pin 34. A first, guide pin 48 extends from arm 32 for sliding engagement in slot 45 as the device 12 pivots about pin 34. A spring-loaded locking pin 50 extends transversely through aligned openings in the end of arm 32 for releasable engagement in any one of the openings 46 to lock the device in a selected angular position. In an alternative arrangement, the bracket 44 may be mounted on arm 32 and the spring loaded pop or lock pin 50 may be mounted on upright member 18. Thus, both the length and the angular orientation of the adjustable support arm 12 can be readily adjusted. A gas-assisted shock device 51 is connected between rear upright 16 and arm 32 so as to raise the arm slowly when pin 50 is released, assisting a user in raising arm 32.

As best illustrated in FIGS. 2 and 3, a mounting rod 52 having forwardly projecting, opposite end plates 53,54 is secured transversely across the forward end 55 of extendible arm 36. The arm 36 is secured to rod 52 at a location offset from the center of the rod, as best illustrated in FIG. 2, since the arm 36 is positioned on one side of the frame upright 18. Thus, mounting rod 52 will be centered relative to the support frame. Roller bar 56 is rotatably mounted between end plates 53 and 54, and a roller pad 58 of cushioning material such as foam or the like is secured over bar 56, as illustrated in FIG. 4. The rod 52 is secured to arm 36 such that the pad mounting plates 53 and 54 are inclined slightly downwardly from the axis of arm 36, as best illustrated in FIG. 3. The angle of inclination is preferably of the order of 10°.

A seat mounting bracket 60 is removably mountable on extendible arm 36 at an appropriate location relative to forward upright 18. Bracket 60 has a C or hook shaped channel 62 extending along one side for engaging over the arm 36. A spring loaded lock pin 64 extends through a transverse opening 65 extending through the lower wall 66 of channel 62 for releasable engagement in a selected opening 38 in arm 36 in order to releasably secure the bracket 60 onto the arm 36. Thus, the same openings 38 in arm 36 are used both to mount the seat mounting bracket on the arm and also to secure the arm at a selected extension relative to rear arm 32. A seat cushion or pad 68 is secured to the upper flat portion of bracket 60. When the bracket 60 is secured to arm 36, it will form a seat together with back rest 30. Since the arm 36 extends to one side of the upright 18, the bracket is not centered on arm 36 but projects out to the opposite side of the arm 36 so that it is centered relative to the upright 18 on which the back rest 30 is mounted, as best illustrated in FIG. 1.

Figure 4A:
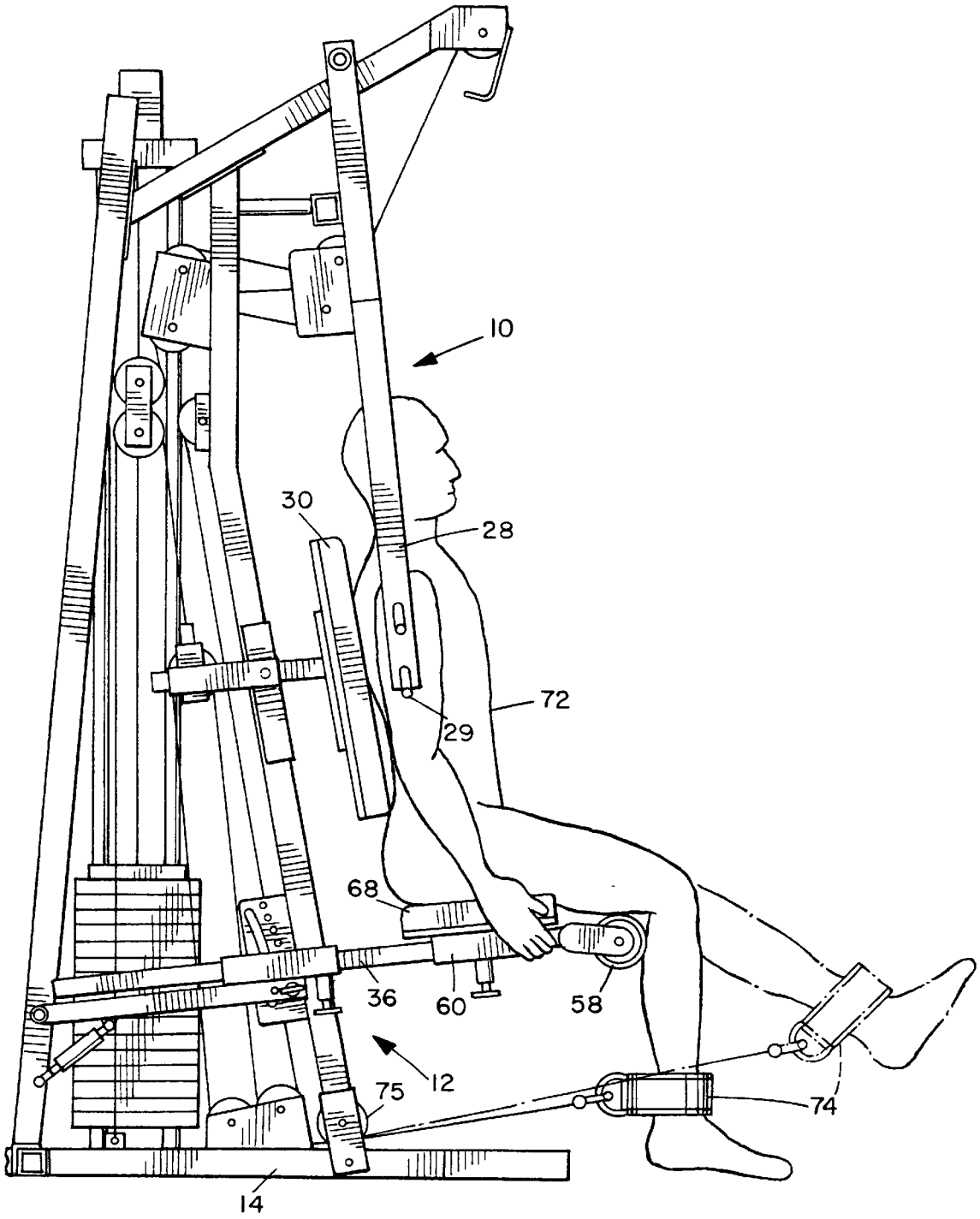
FIG. 4A illustrates a different exercise which may be performed with the device positioned as in FIG. 4.
Figure 5:
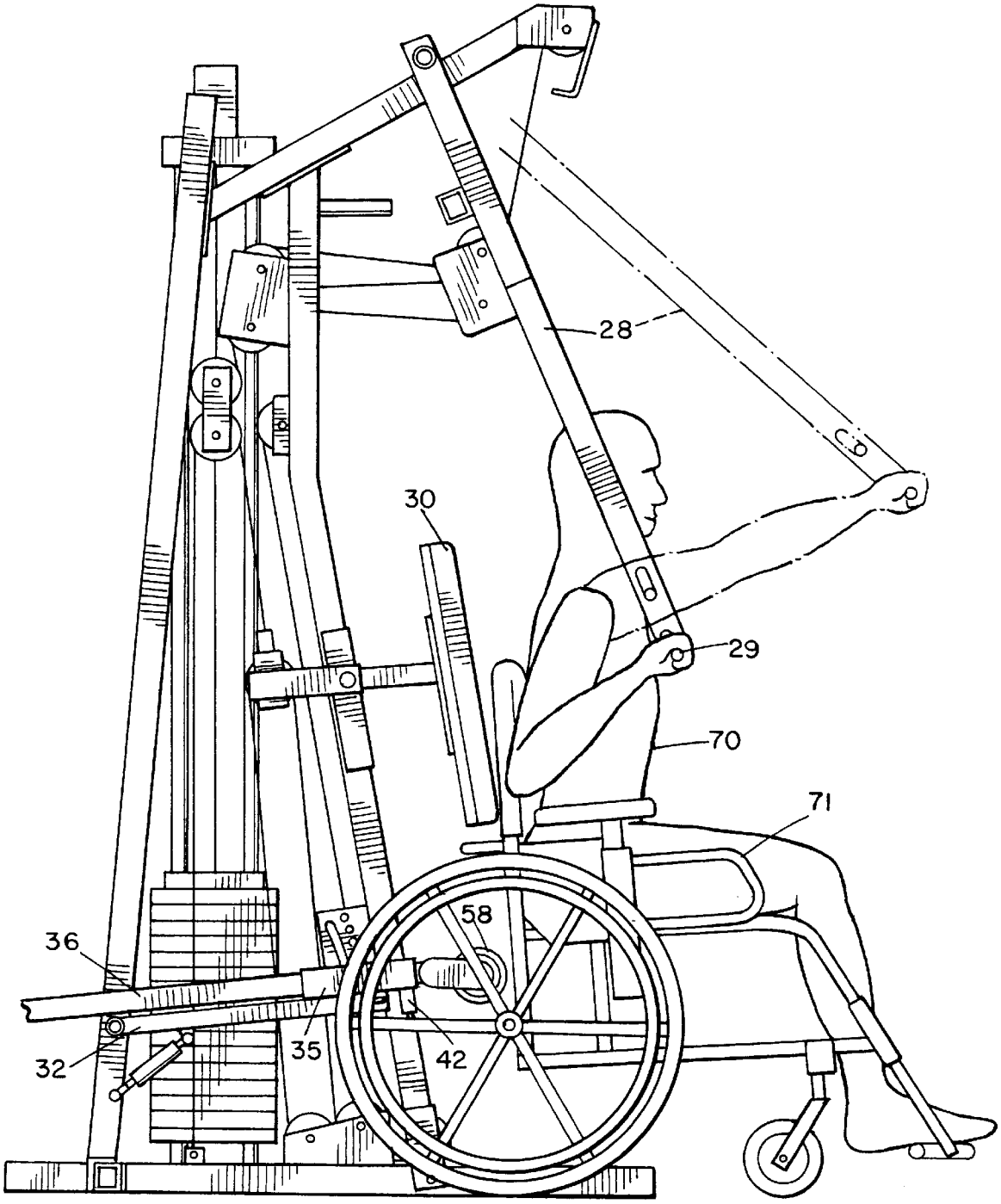
FIG. 5 is a view similar to FIG. 4 illustrating the adjustable support device in a different position for use of the machine by a handicapped person.
Figure 6:
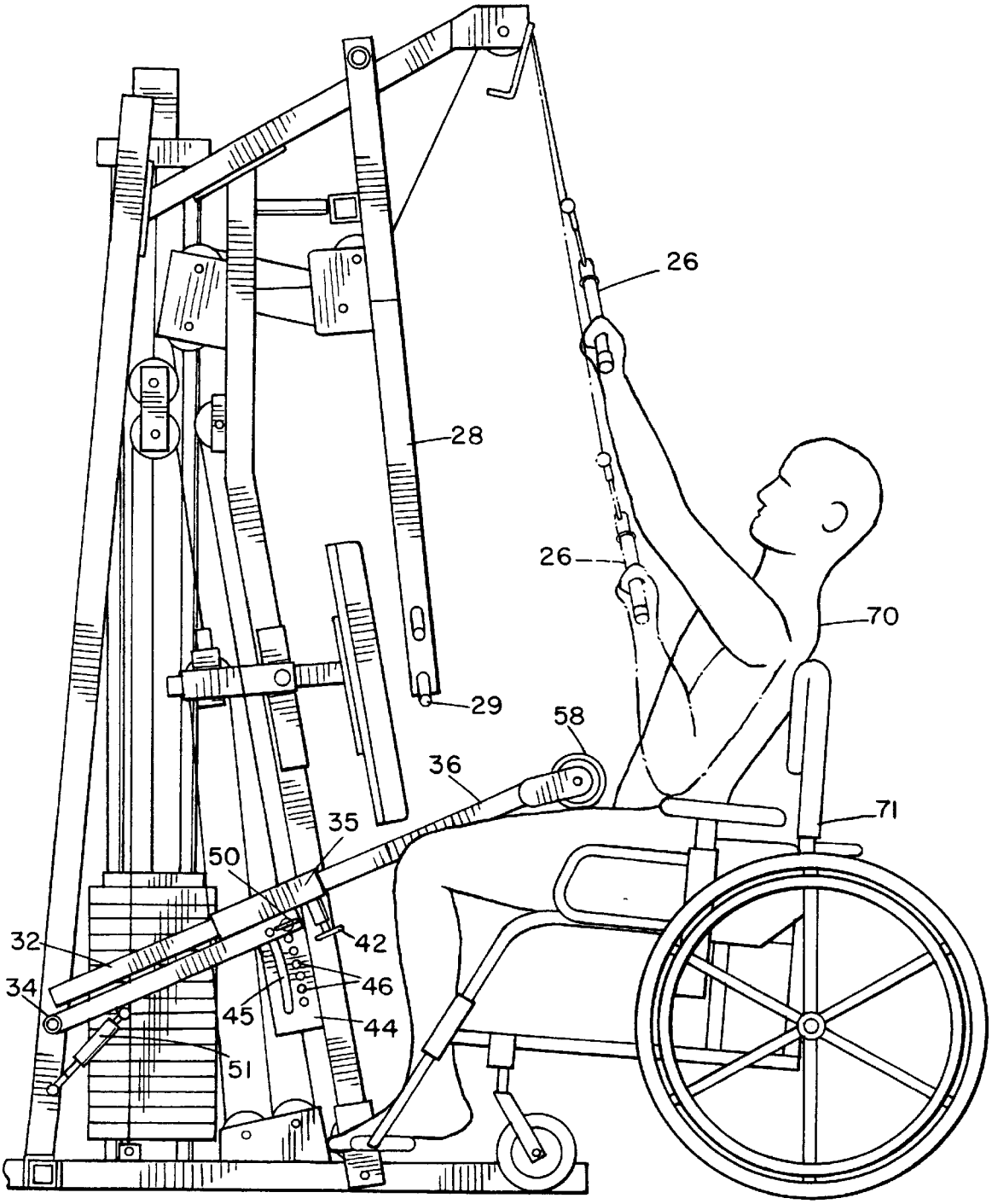
FIG. 6 illustrates a different position of the adjustable support device for allowing a handicapped user to perform pull down exercises.
Figure 7:
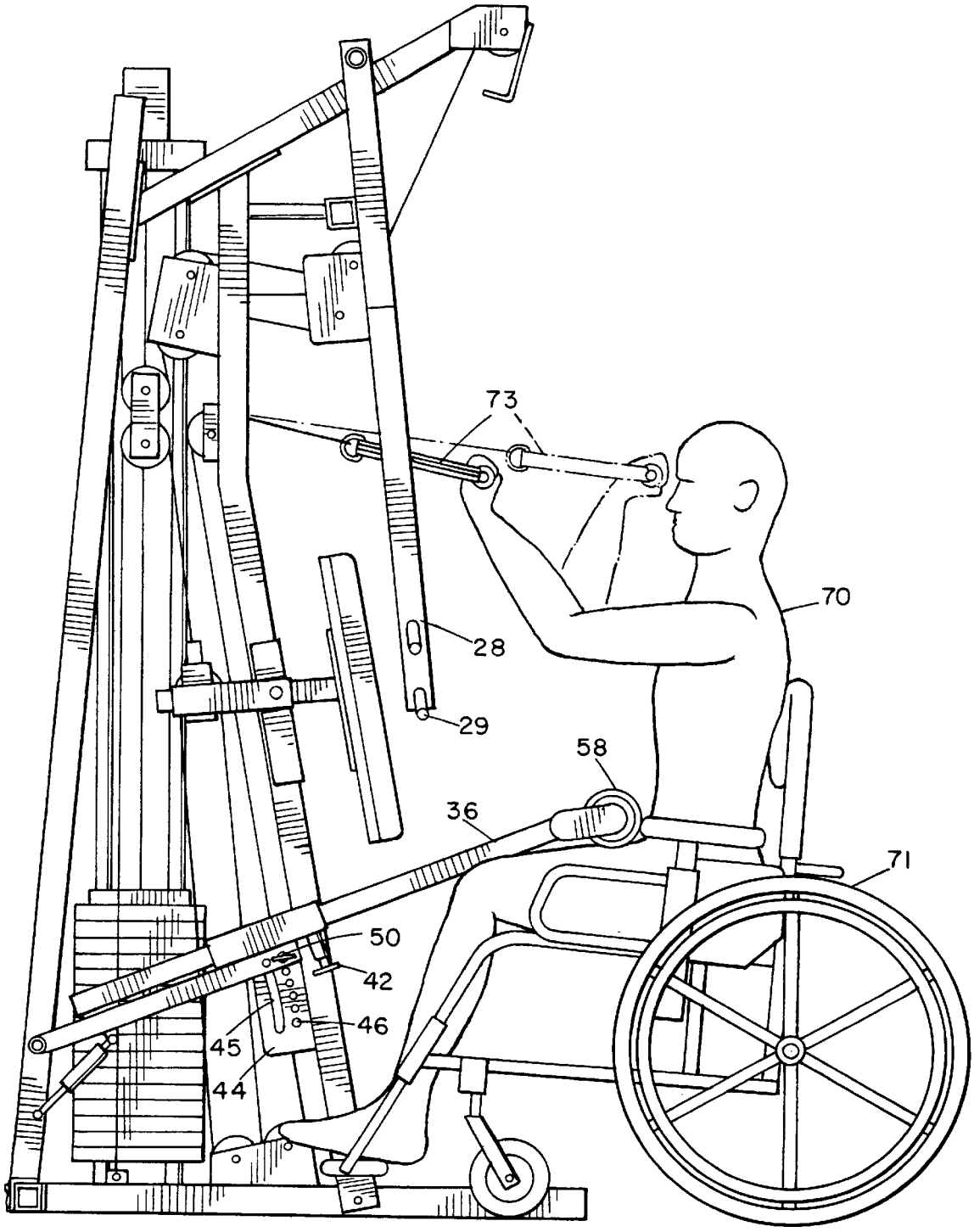
FIG. 7 is a similar view to FIG. 6 illustrating a handicapped user performing arm pull exercises.
Figure 8:
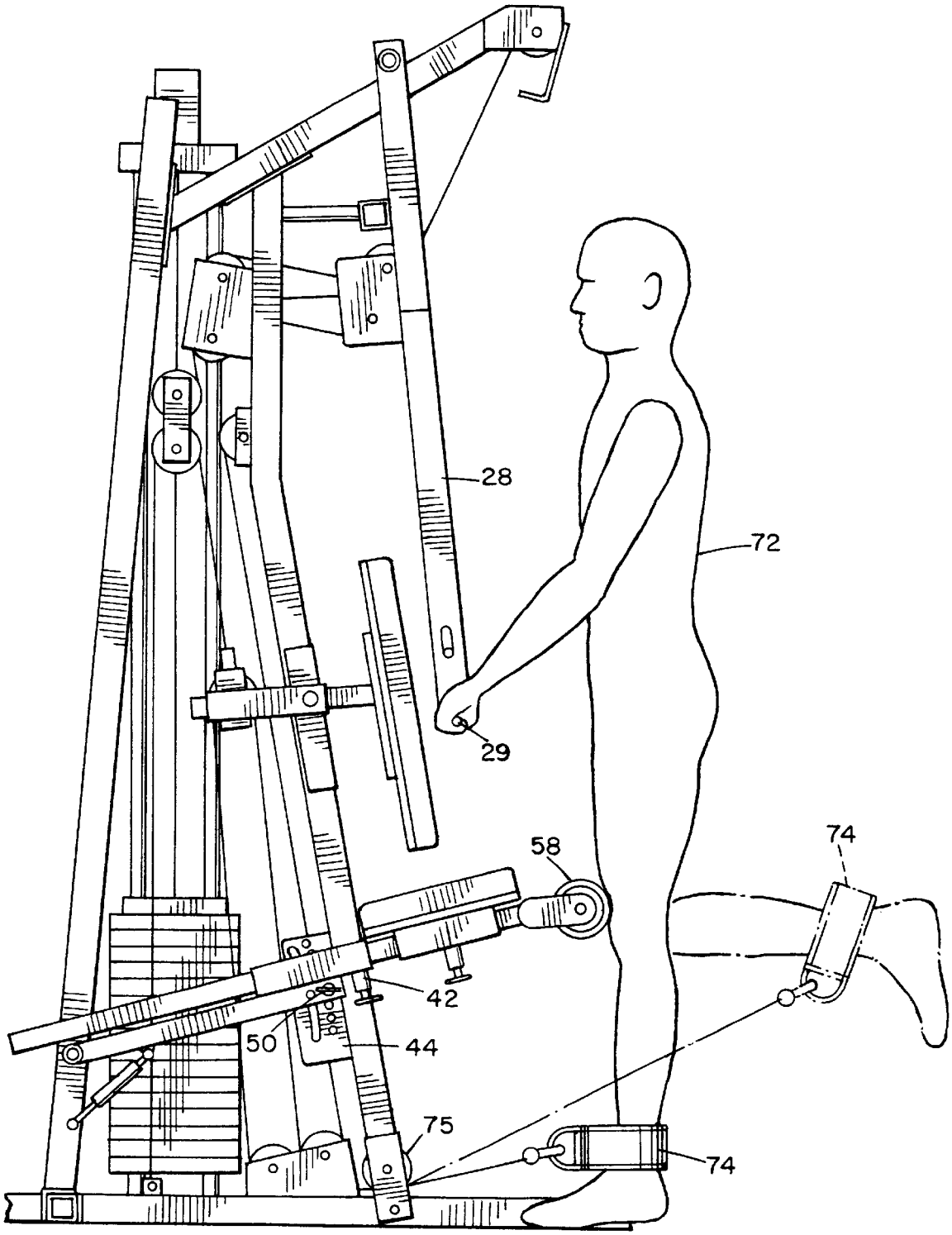
FIG. 8 is a side elevational view of the machine illustrating positioning of the adjustable support device for performing a standing leg curl.

The adjustable support arm assembly may be readily adjusted for use by a handicapped user 70 in a wheelchair 71, as illustrated in FIGS. 5 to 7, or by a non-handicapped user 72, as illustrated in FIGS. 4, 4A and 8. In a first condition, as illustrated in FIG. 4, the support arm 36 carries seat pad 68 and is extended so that the seat pad is located at an appropriate position to form a seat in conjunction with back rest 30 for a non-handicapped user in a conventional, seated position. In this position, the user 72 may perform press-type exercises or leg extension type exercises, as illustrated in FIGS. 4 and 4A. A pair of ankle straps 74 are linked to the weight stack via pulley 75 to allow the user to perform leg extension exercises, as illustrated in FIG. 4A. The roller pad 58 provides support behind the user's knees while performing leg extensions.

If a handicapped user in a wheelchair wishes to use the machine in an equivalent manner to perform chest press exercises or the like, the seat mounting bracket is simply removed from the extended arm 36 by releasing pop pin 64, and the pin 42 is released to allow the arm to be fully retracted into the position illustrated in FIG. 5. In this position, space is left in front of upright member 18 so that a wheelchair can be positioned with its back against back rest 30, so that the handicapped user in FIG. 5 is in an equivalent position to the non-handicapped user in FIG. 4, allowing equal access to the exercise equipment. In this position, the user 70 may grip the handles 29 of chest press arm 28 to perform chest press exercises in the same manner as the non-handicapped user in FIG. 4.

Other adjustments of the support arm assembly may be made for allowing handicapped and non-handicapped users to perform other types of exercises. If a handicapped user wishes to perform pulldown exercises using pull down bar 26, as in FIG. 6, or arm pull exercises of the type illustrated in FIG. 7, using arm pull handles 73 suitably linked to the cable and pulley mechanism, the wheelchair 71 is reversed so that the user 70 faces the back rest 30. The pop pin 50 is pulled back to allow the angle of support arm 36 to be adjusted, with gas-assisted shock device 51 assisting the user in raising the extendible arm. The pop pin 42 is pulled out of the aligned opening to allow the arm 36 to be extended until the roller pad 58 can be positioned on top of the wheelchair user's thighs, as illustrated in FIGS. 6 and 7. The pins 50 and 42 are then released to lock the support arm in the desired position. With this arrangement, the wheelchair user can readily perform the illustrated exercises while the arm 36 will prevent the body of the user from being lifted out of the wheelchair. Thus, the handicapped user may readily perform pull down exercises by pulling down on bar 26 as in FIG. 6, or arm pull exercises by pulling on arm pull handles 73 as in FIG. 7. Thus, the adjustable arm assembly 12 allows the exercise or weight machine to be used conveniently by a handicapped user.

The support arm can also be readily adjusted to permit a non-handicapped user to perform different exercises, such as a standing leg curl as illustrated in FIG. 8. For this exercise, pop pin 42 is drawn back to release arm 36, and the arm is retracted sufficiently to allow the user to stand in the illustrated position. Pop pin 50 is also retracted and the angle of the arm is adjusted until roller pad 58 is at an appropriate height to form a support against the user's knees. The angle is adjusted depending on the height of the user so that the roller pad 58 bears against the user' knees. This provides a convenient support or bearing surface for performing leg curls. An ankle strap 74 is secured around each of the user's ankles in turn and leg curls may be performed as illustrated with the user gripping handles 29 for stability.

The adjustable arm assembly allows the arm to be used with or without a seat, and to be adjusted both up and down and in and out depending on the mode of use of the machine and the height of the user. Thus, the same exercise or weight machine can be used readily by both handicapped and non-handicapped users.

Although a preferred embodiment of the invention has been described above by way of example only, it will be understood by those skilled in the field that modifications may be made to the disclosed embodiment without departing from the scope of the invention, which is defined by the appended claims.

We claim:

1. An exercise apparatus, comprising:

a support frame having a base and at least one upright member extending upwardly from the base, the base having a forward end and a rearward end, and the frame having a space defined forwardly of said upright member which is occupied by a user when performing exercises;

resistance means on the frame for providing resistance to at least one exercise performed on the apparatus;

at least one exercise member for performing an exercise;

a cable and pulley linkage assembly linking the resistance means to the exercise member;

an adjustable support assembly mounted on said frame and having an extendible support portion movable between a fully extended position projecting forwardly into said space from said upright member and a retracted position out of said space;

the support assembly comprising a first arm having a first end mounted on said frame and a second end, and a second arm comprising said extendible portion having a first end slidably mounted on said first arm and a second, outer end spaced outwardly from the second end of said first arm, said second arm being movable relative to said first arm between said extended and retracted positions to adjust the length of said support assembly, a major portion of the second arm being retracted rearwardly of said upright member and the outer end of said second arm being located adjacent said upright member in the retracted position; and a seat pad releasably mountable on said extendible support portion in said extended position for supporting a user seated on said seat pad when performing an exercise in a seated position;

wherein the extendible portion does not project into the space located in front of said upright member when the extendible portion is in the retracted position.

2. The apparatus as claimed in claim 1, wherein the second arm is telescopically mounted on the second end of the first arm, the second arm having a series of spaced openings extending along at least a major portion of its length, and a first spring-loaded locking pin is mounted on said first arm for releasable engagement through one of said openings when said second arm is at any one of a series of extended positions relative to said first arm.

3. The apparatus as claimed in claim 2, wherein the seat pad includes a seat mounting bracket for releasable engagement over said second arm, said bracket having a second spring-loaded locking pin for engagement through a selected one of said spaced openings to releasably secure said mounting bracket at a selected position on said second arm.

4. An exercise apparatus, comprising:

a support frame having a base and at least one upright member extending upwardly from the base, the base having a forward end and a rearward end, and the frame having a space defined forwardly of said upright member which is occupied by a user when performing exercises;

resistance means on the frame for providing resistance to at least one exercise performed on the apparatus;

at least one exercise member for performing an exercise;

a cable and pulley linkage assembly linking the resistance means to the exercise member;

an adjustable support assembly mounted on said frame and having an extendible support portion movable between a fully extended position projecting forwardly into said space from said upright member and a retracted position positioned rearwardly of said space;

the support assembly comprising a first arm pivotally mounted on said support frame for rotation about a pivot axis to adjust the height of said extendible portion, said extendible portion comprising a second arm slidably mounted on said first arm for movement between said fully extended and retracted positions to adjust the length of said support assembly, a major portion of the second arm being retracted rearwardly of said upright member and out of said space in the retracted position, and a first releasable locking means for releasably locking said first arm in any one of a plurality of different angular positions at different angles relative to said base; and a seat pad mountable on said extendible support portion in said extended position for supporting a user seated on said seat pad when performing an exercise in a seated position.

5. The apparatus as claimed in claim 4, wherein the first arm has a first end mounted on said support frame, a second end, and a longitudinal axis, and the second arm has a first end slidably mounted relative to said first arm and a second, outer end spaced outwardly from the second end of said first arm, and a second releasable locking means for releasably locking said second arm at a selected extension relative to said first arm to adjust the length of said support assembly.

6. The apparatus as claimed in claim 5, wherein one of said arms has a series of spaced openings and said second releasable locking means comprises a spring-loaded locking pin on the other arm for releasable engagement in an aligned opening to secure said extendible second arm at a selected extension relative to said first arm.

7. An exercise apparatus, comprising:

a support frame having a base and at least one upright member extending upwardly from the base, the base having a forward end and a rearward end, and the frame having a space defined forwardly of said upright member which is occupied by a user when performing exercise;

resistance means on the frame for providing resistance to at least one exercise performed on the apparatus;

at least one exercise member for performing an exercise;

a cable and pulley linkage assembly linking the resistance means to the exercise member;

an adjustable support assembly mounted on said frame and having an extendible support portion movable between a fully extended position projecting from said upright member and a retracted position;

the support assembly comprising a first arm pivotally mounted on said support frame for rotation about a pivot axis to adjust the height of said extendible portion, said extendible portion comprising a second arm slidably mounted on said first arm for movement between said fully extended and retracted positions, and releasable locking means for releasably locking said first arm in any one of a plurality of different angular positions about said pivot axis;

a seat pad mountable on said extendible support portion in said extended position for supporting a user when performing an exercise in a seated position;

wherein the extendible portion does not project into the space located in front of said upright member when the extendible portion is in the retracted position; and the releasable locking means comprising a first part mounted on said upright member and a second part mounted on said support assembly, one of said parts comprising a plate having a series of spaced openings extending along an arc centered on said pivot axis, each opening corresponding to a different orientation of said arm, and the other part comprising a spring-loaded locking pin for releasable engagement in a selected opening to secure said arm in a selected angular orientation.

8. An exercise apparatus, comprising:

a support frame having a base and at least one upright member extending upwardly from the base, the base having a forward end and a rearward end, and the frame having a space defined forwardly of said upright member which is occupied by a user when performing exercises;

resistance means on the frame for providing resistance to at least one exerciser performed on the apparatus;

at least one exercise member for performing an exercise;

a cable and pulley linkage assembly linking the resistance means to the exercise member;

an adjustable support assembly mounted on said frame and having an extendible support portion movable between a fully extended position projecting forwardly into said space from said upright member and a retracted position out of said space;

the support assembly comprising a first arm having a first end mounted on said frame and a second end, and a second arm comprising said extendible portion having a first end slidably mounted on said first arm and a second, outer end spaced outwardly from the second end of said first arm, said second arm being movable relative to said first arm between said extended and retracted positions to adjust the length of said support assembly, a major portion of the second arm being retracted rearwardly of said upright member and the outer end of said second arm being located adjacent said upright member in the retracted position; and a seat pad mountable on said second arm in said extended position for supporting a user seated on said seat pad when performing an exercise in a seated position, and removable from said second arm when said second arm is in said retracted position;

wherein the extendible portion does not project into the space located in front of said upright member when the extendible portion is in the retracted position; and a roller pad mounted at the outer end of said second arm.

9. The apparatus as claimed in claim 8, wherein the first end of said assembly is pivotally mounted on said frame for rotation about a first pivot axis to adjust the height of said roller pad, said assembly further including locking means for releasably locking said assembly at a selected orientation, whereby said roller pad is located behind a user's knees when seated on a seat pad secured to said extended portion, and may be located on top of the legs of a user seated in a wheelchair facing the rear end of the frame to provide a hold down device.

10. An exercise apparatus, comprising:

a support frame having a base and at least one upright member extending upwardly from the base, the base having a forward end and a rearward end, and the frame having a space defined forwardly of said upright member which is occupied by a user when performing exercise;

resistance means on the frame for providing resistance to at least one exercise performed on the apparatus;

at least one exercise member for performing an exercise;

a cable and pulley linkage assembly linking the resistance means to the exercise member;

an adjustable support assembly mounted on said frame and having an extendible support portion movable between a fully extended position projecting forwardly from said upright member and a retracted position in which the extendible portion is retracted from the space defined forwardly of the upright member;

a seat pad releasably mountable on said extendible support portion in said extended position for supporting a user seated on said seat pad when performing an exercise in a seated position; and the seat pad comprising a seat mounting bracket for releasable engagement over said extendible portion, the extendible portion having a first opening and the mounting bracket having a second opening for alignment with the first opening when engaged over said extendible portion, and a releasable locking pin for releasable locking engagement through said aligned openings to releasably secure said mounting bracket to said extendible portion.

11. A method of converting a weight-lifting exercise machine for use by either a handicapped user in a wheelchair or a non-handicapped user, comprising the steps of:

adjustably mounting a seat supporting arm having an outer end on a support frame of an exercise machine in a first position in which the arm projects forwardly from an upright member of the frame carrying a seat back rest when the machine is to be used by a non-handicapped user in a seated position;

releasably securing a seat pad to the arm in the first position;

when the machine is to be used by a handicapped user in a wheelchair with the back of the wheelchair facing the upright member, removing the seat pad from the arm and retracting the arm into a second, retracted position in which it does not project forwardly into the space to be occupied by the wheelchair;

releasably securing the arm in the retracted position; and positioning the wheelchair in the space previously occupied by the extended seat supporting arm so that the wheelchair user is in an equivalent position to a non-handicapped user when seated on said seat pad and against said back rest.

12. The method as claimed in claim 11, including the steps of:

attaching a cushioning pad to the outer end of the seat supporting arm; and adjusting the length and angular orientation of the arm so that the pad can rest on top of the legs of a user seated in a wheelchair facing the upright member.

* * * * *